United States Patent [19]

Zoschak

[11] 4,344,371

[45] Aug. 17, 1982

[54] VAPOR GENERATING SYSTEM HAVING INTEGRALLY FORMED GASIFIERS EXTENDING TO EITHER SIDE OF THE HOPPER PORTION OF THE GENERATOR

[75] Inventor: Robert J. Zoschak, Rutherford, N.J.

[73] Assignee: Foster Wheeler Energy Corporation, Livingston, N.J.

[21] Appl. No.: 249,567

[22] Filed: Mar. 31, 1981

[51] Int. Cl.[3] ..... C10K 3/00; F22B 1/00

[52] U.S. Cl. ..... 110/229; 122/4 D; 110/245; 110/345; 110/347; 48/128

[58] Field of Search ..... 122/4 D, 5, 7; 110/245, 110/342, 229, 347; 48/128

[56] References Cited

U.S. PATENT DOCUMENTS

| | | | |
|---|---|---|---|
| 3,356,075 | 12/1967 | Livingston | 110/347 |
| 3,581,715 | 6/1971 | Singer | 122/5 |
| 3,599,610 | 8/1971 | Spector | 122/5 |
| 3,784,676 | 1/1974 | Moss | 423/242 |
| 3,807,090 | 4/1974 | Moss | 48/128 |
| 3,877,440 | 4/1975 | Winkin | 110/342 |
| 3,905,336 | 9/1975 | Gamble et al. | 122/4 D |
| 3,927,627 | 12/1975 | Brunn | 110/342 |
| 4,191,115 | 3/1980 | Yang et al. | 110/347 |
| 4,205,630 | 6/1980 | Regan | 110/347 |
| 4,262,610 | 4/1981 | Hein et al. | 110/342 |

*Primary Examiner*—Henry C. Yuen

*Attorney, Agent, or Firm*—Marvin A. Naigur; John E. Wilson; Warren B. Kice

[57] ABSTRACT

A vapor generating system in which a furnace section is provided that is formed by four upright walls, the lower portion of two opposed walls being slanted inwardly to form a hopper portion. A plurality of openings are formed in each of the opposed walls immediately above its slanted portion. Two gasifiers extend adjacent said opposed wall portions, respectively, and surround the respective slanted wall portions and openings, so that the respective interiors of the gasifiers communicate with the openings. A bed of adsorbent material is supported in each gasifier for adsorbing the sulfur generated as a result of the gasification of fuel introduced into the gasifier and air is passed through the bed of adsorbent material to fluidize said material so that, upon combustion of said fuel, a substantially sulfur-free product gas is produced which passes from the gasifier, through the openings and into the furnace section.

11 Claims, 3 Drawing Figures

VAPOR GENERATING SYSTEM HAVING INTEGRALLY FORMED GASIFIERS EXTENDING TO EITHER SIDE OF THE HOPPER PORTION OF THE GENERATOR

BACKGROUND OF THE INVENTION

This invention relates to a vapor generating system and, more particularly, to such a system in which a vapor generator burns a relatively low BTU product gas essentially free of sulfur which is generated by a gasifier located integral with the vapor generator.

The Environmental Protection Agency and various state agencies have established standards of performance that define maximum allowable sulfur dioxide emission levels for fossil fueled power stations. In response to these standards, a generation of stack gas clean up equipment has been designed to remove or scrub sulfur dioxide from the steam generator flue gases prior to release into the atmosphere. Since large volumes of gas with dilute sulfur dioxide concentrations are encounted at the steam generator exit, the stack gas clean up equipment becomes large and expensive.

Instead of controlling sulfur dioxide emissions by treating the stack gases it is advantageous to remove sulfur from the fuel prior to combustion in the steam generator, since at this stage the volume of gases requiring treatment is significantly reduced. To this end an oil gasification process has evolved that involves the partial combustion of fuel such as heavy fuel oil or particulate coal in a fluidized bed of lime particles. Desulfurization is accomplished through reaction with the lime particles and a combustible off-gas is produced that is ducted to a steam generator where combustion is completed in commercially available gas burners.

However in these systems, hot gas ducting has to be provided along with a cyclone separator in the case of particulate coal, to pass the product gas from the gasifier to the steam generator. However, this equipment is expensive and, in addition, since the cyclone separators were less than completely efficient, the coal particles would enter the furnace and cause an appreciable build up of carbon. Therefore, the furnace and/or the gasifier had to be designed to burn the carbon, which often comprised the efficiency of the system. Accordingly, it is an object of the present invention to provide a two-stage combustion system with sulfur removal in the first stage gasifier and combustion of the gas together with the carbon particulates in the second stage furnace.

SUMMARY OF THE INVENTION

It is therefore an object of the present invention to provide a vapor generating system in which sulfur is removed from the fuel prior to combustion in the vapor generator.

It is a further object of the present invention to provide a system of the above type in which a chemically active fluidized bed is provided for producing a product gas substantially free of sulfur which is passed to the vapor generator.

It is a still further object of the present invention to provide a system of the above type in which the sulfur free product gas is generated in a gasifier and passed to the vapor generator without the use of ducting and/or cyclone separators.

It is a still further object of the present invention to provide a system of the above type in which a gasifier is formed integrally with the vapor generator.

It is a still further object of the present invention to provide a system of the above type in which two gasifiers are respectively provided to either side of the hopper portion of the furnace section of the vapor generator.

Toward the fulfillment of these and other objects, the system of the present invention comprises a vapor generator including an upright furnace section the lower portion of which forms a hopper. Two gasifiers are respectively provided to either side of the hopper and each supports a bed of adsorbent material for the sulfur generated as a result of the combustion of fuel introduced into the bed. Air is passed through the bed of adsorbent material to fluidize the material so that, upon combustion of the fuel, a substantially sulfur-free product gas is produced. The gasifiers communicate with the interior of the furnace section so that the product gas from the gasifier passes into the furnace section for combustion.

BRIEF DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in conjunction with the accompanying drawings in which.

DESCRIPTION OF THE PREFERRED EMBODIMENT

Figure 1:
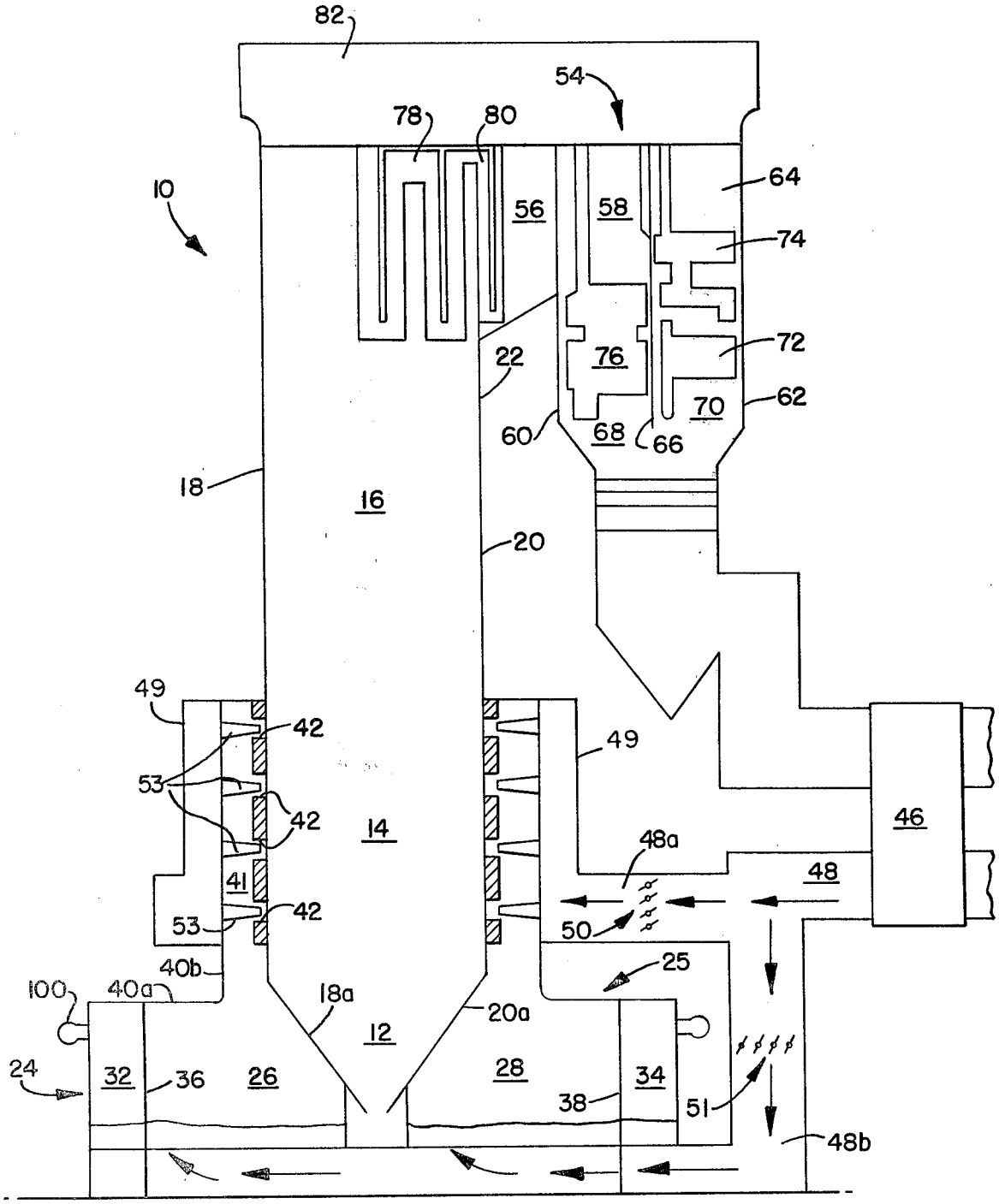
FIG. 1 is a schematic sectional view of the steam generating/gasifying system of the present invention.

Referring specifically to FIG. 1 of the drawings, the reference numeral 10 refers in general to a vapor generator utilized in the system of the present invention which includes a lower furnace section 12, an intermediate furnace section 14, and an upper furnace section 16. The boundary walls defining the furnace sections 12, 14 and 16 include a front wall 18, a rear wall 20 and two sidewalls extending between the front and rear wall, with one of said sidewalls being referred to by the reference numeral 22.

Although only shown schematically for the convenience of presentation, it is understood that each of the walls 18, 20, and 22 are formed of a plurality of tubes having continuous fins extending outwardly from diametrically opposed portions thereof, with the fins adjacent tubes being connected together in any known manner, such as by welding, to form a gas-tight structure.

The lower portions of the front wall 18 and the rear wall 20 are sloped inwardly from the intermediate furnace section 14, as shown by the reference numerals **18*a* and 20*a*, respectively, so that the lower furnace section 12 is in the form of a hopper. Two integral gasifiers 24 and 25 are formed to either side of the lower furnace section 12 and, more particularly, adjacent the walls 18*a* and 20*a*, respectively, with each of the latter thus functioning as a common wall between the lower furnace sections and its respective gasifier. The gasifiers 24 and 25 consist of gasifying sections 26 and 28 respectively, and regenerating sections 32 and 34, respectively, separated from their respective gasifying sections by partitions 36 and 38**, respectively.

The gasifier 24 has a horizontal upper wall portion 40*a* and a vertical upper wall portion 40*b* with the latter extending in a parallel spaced relation to the lower portion of the front wall 18 immediately above the slanted portion 18*a*, to define an upper chamber 41 which communicates with a plurality of refractory aligned openings 42 formed along the latter lower portion of the front wall 18. Since the upper wall of the gasifier 25 is formed in a similar manner, it will not be described in detail.

A preheater 46 is provided in a heat exchange relation with a duct 48 which receives air from an external source and which branches into a duct 48*a* communicating with a windbox 49 which surrounds the chamber(s) 41 of the gasifiers 24 and 25. The duct 48 also branches into a duct 48*b* extending below the gasifiers 24 and 25 and communicating therewith through a grate forming the floors of the gasifiers as will be described later. A series of dampers 50 are provided in the duct 48*a* and a series of dampers 51 are provided in the duct 48*b* for controlling the flow of air through the ducts. A plurality of nozzles 53 provide communication between the windbox 49 and the intermediate furnace section 14 through the openings 42. Further details of the arrangement and operation of the gasifiers 24 and 25 will be described later.

A heat recovery area, shown in general by the reference numeral 54 is provided adjacent the upper furnace section 16 in gas flow communication therewith and includes a vestibule section 56 and a convection section 58.

The convection section 58 includes a front wall 60, a rear wall 62 and two sidewalls 64, with one of the latter being shown in FIG. 1. It is understood that the rear wall 62, the sidewalls 64, and the lower portions of the front wall 60 are formed of a plurality of vertically extending, finned, interconnected tubes in a similar manner to that of the furnace sections, and that slots or openings are provided in the upper portion of the wall 60 to permit communication between the vestibule section and the convection section 58.

A partition wall 66, also formed by a plurality of finned interconnected tubes, is provided in the convection section 58 to divide the latter into a front gas pass 68 and a rear gas pass 70. An economizer 72 is disposed in the lower portion of the rear gas pass 70, a primary superheater 74 is disposed immediately above the economizer, and a bank of reheater tubes 76 is provided in the front gas pass 68.

A platen superheater 78 is provided in the upper furnace section 16 and a finishing superheater 80 is provided in the vestibule section 56 in direct fluid communication with the platen superheater 78.

Although not shown in the drawings, it is understood that a plurality of division walls, each formed by a plurality of finned interconnected tubes, could be provided with a portion of each wall being disposed adjacent the intermediate furnace section 14 and the front wall 18. The division walls would penetrate a portion of the tubes of the front wall 18 and extend upwardly within the intermediate furnace section 14 and the upper furnace section 16.

A roof 82 is disposed in the upper portion of the vapor generator 10 and consists of a plurality of tubes having fins connected in the manner described above but extending horizontally from the front wall 18 of the furnace section to the rear wall 62 of the convection section 58.

Figure 2:
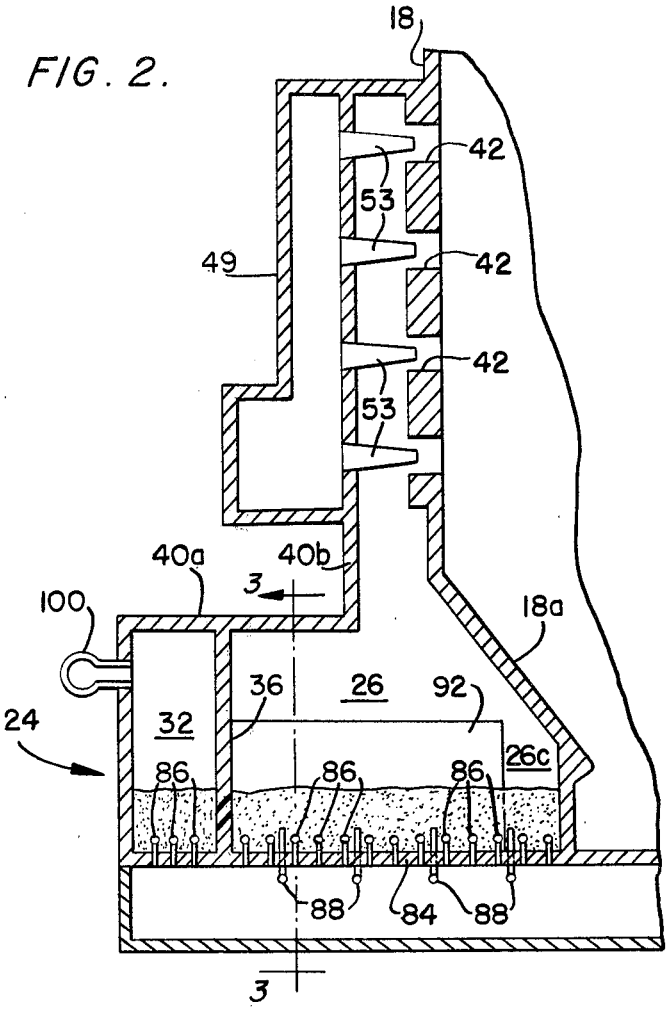
FIG. 2 is an enlarged sectional view depicting a portion of the system of FIG. 1.
Figure 3:
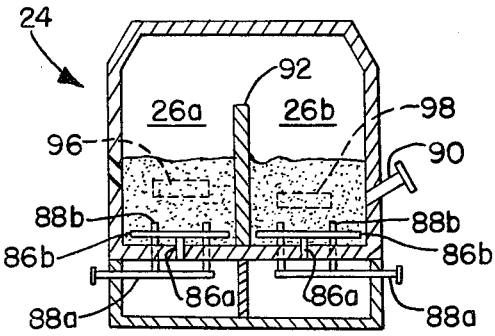
FIG. 3 is a cross-sectional view taken along the lines 3—3 of FIG. 2.

Referring to FIGS. 2 and 3, which depicts the gasifier 24 in detail, a grate 84 forms the floor of the gasifier and receives a plurality of T-shaped air distributor pipe assemblies 86 which receive air from the duct 48*b* and introduces the air into the gasifying section 26 and the regenerating section 32. As better shown in FIG. 3, each pipe assembly 86 includes a vertical pipe 86*a* which extends through an opening in the grate 84 and a horizontal pipe 86*b* connected in registry with the vertical pipe.

A plurality of fuel distributor pipe assemblies 88 extend through other openings in the grate 84 below the gasifying section 26 with each assembly including a horizontal pipe 88*a* extending below the grate 84 and a vertical pipe 88*b* extending through an opening in the grate and connected in registry with the horizontal pipe. An end portion of each horizontal pipe 88*a* extends through a sidewall of the gasifier 24 and is adapted to be connected to a source of fuel (not shown) which could be oil or particulate coal.

A feeder 90 extends through a sidewall of the gasifier 24 and is adapted to feed an adsorbent, such as limestone, into the gasifying section 26.

A divider wall 92 is disposed in the gasifying section 26 to divide the section 26 into chambers 26*a* and 26*b* (FIG. 3). The divider wall 92 extends from the partition 36 (FIG. 2) to an area spaced from the front wall portion 18*a* to define a passage 26*c* (FIG. 2) communicating with the chambers 26*a* and 26*b*.

An inlet slot 96 and an outlet slot 98 are formed in the partition 36 with the former communicating the chamber 26*a* with the regenerating section 32 and the latter communicating the chamber 26*b* with the regenerating section.

As a result of this arrangement a mixture of limestone and a fuel continually flows from the chamber 26*b*, around the passage 26*c*, through the chamber 26*a* and the slot 96 and into the regenerating section 32 and, from the latter section, through the slot 98 and into the chamber 26*b* for recirculation.

A discharge manifold 100 (FIG. 2) communicates with the upper portion of the regenerating section 32 to discharge the sulfur gas produced in the regenerating section to external sulfur recovery equipment (not shown).

Since the gasifier 25 is arranged and operates in a manner identical to the gasifier 24, it will not be described in detail.

In operation, the temperature in each fluidized bed in the gasifying sections 26 and 28 of the gasifiers 24 and 25, respectively is maintained at a predetermined elevated value (such as 1600° F.) by control of the fuel entering the beds. Air from the duct 48*b* is admitted into the gasifying sections 26 and 28 through the air distributor pipe assemblies 86 in substoichiometric proportions to limit the amount of combustion and heat release; while flue gas is used as an inert, heat absorbing medium to control the overall process temperature.

Partial combustion of the fuel entering the gasifying sections 26 and 28 with approximately 25 to 30% stoichiometric air furnishes sufficient heat to partially combust the fuel, and, when oil is used, to vaporize and crack the remaining oil. This partial combustion results in the formation of hydrogen sulfide which reacts with the fluidized bed of lime to form calcium sulfide and water. The gaseous product of this process is an essentially sulfur free and vanadium free fuel gas possessing a heating value of approximately 200 BTU/cu. ft. This gas rises in the gasifying sections 26 and 28 by natural convection and enters the chamber(s) 41 and passes through the openings 42 into the intermediate furnace section 14 where it combines with the air from the windbox 49 passing through the nozzles 53 and through the openings 42, so that combustion is completed in a conventional manner. The capacity for sulfur retention by the gasifying sections 26 and 28 is maintained by the continuous removal of the sulfated lime and the replenishing of this material with sulfur free lime through the feeders 90.

Air from the duct **48*b* is admitted into the regenerating sections 32 and 34 through the pipe assemblies 86 and the calcium sulfide formed in the gasifying sections 26 and 28 is circulated through the regenerating sections 32 and 34, respectively, as discussed above, to convert the calcium sulfide to calcium oxide while producing an off-gas with a high sulfur dioxide concentration. As the calcium sulfide is transferred into the oxygen rich regenerating sections 32 and 34** preferably at about 1900° F. the following reaction takes place:

$$CaSO_4 + CaS + O_2 \rightarrow 2CaO + 2SO_2$$

The sulfur dioxide formed by the above reaction leaves the regenerating sections 32 and 34 through the discharge manifold(s) 100, and is recovered by external equipment from the gas stream in the form of elemental sulfur, while calcium oxide is recirculated back to the gasifying sections 26 and 28 for re-use as a sulfur absorbent.

Referring again to FIG. 1, the combustion gases produced as a result of the combustion of the sulfur free product gases from the gasifier 24 in the intermediate furnace section 14 pass upwardly to the upper furnace section 16 and through the heat recovery area 54 before exiting from the front gas pass 46 and the rear gas pass 48. As a result, the hot gases pass over the platen superheater 78, the finishing superheater 80 and the primary superheater 54, as well as the reheater 76 and the economizer 72 to add heat to the fluid flowing through these circuits. The hot gases then pass through the air preheater 46 to preheat the air entering the duct 48.

Although not shown in the drawings for clarity of presentation, it is understood that suitable inlet and outlet headers, downcomers and conduits, are provided to place the tubes of each of the aforementioned walls and heat exchangers as well as the roof in fluid communication to establish a flow circuit for connecting the water to vapor. To this end, feedwater from an external source is passed through the economizer 72 to raise the temperature of the water before it is passed to inlet headers (not shown) provided at the lower portions of the furnace walls 18, 20 and 22. All of the water flows upwardly and simultaneously through the walls 18, 20 and 22 to raise the temperature of the water further to convert at least a portion of same to vapor, before it is collected in suitable headers located at the upper portion of the vapor generator 10. The fluid is then passed downwardly through suitable downcomers, or the like, and then upwardly through the aforementioned division walls to add additional heat to the fluid. The fluid is then directed through the walls 60, 62 and 66 of the heat recovery area 54 after which it is collected and passed through the roof 82. From the roof 82, the fluid is passed via suitable collection headers, or the like, to separators (not shown) which separate the vapor portion of the fluid from the liquid portion thereof. The liquid portion is passed from the separators to a drain manifold and heat recovery circuitry (not shown) for further treatment, and the vapor portion of the fluid in the separators is passed directly into the primary superheater 74. From the latter, the fluid is spray attemperated after which it is passed to the platen superheater 78 and the finishing superheater 80 before it is passed in a dry vapor state to a turbine, or the like.

As a result of the foregoing a sulfur free product is produced and is introduced directly into the vapor generator without the need for hot gas ducting and cyclone separators.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. An integral generator/gasifier system comprising a vapor generator including a furnace section formed by four upright walls, the lower portion of two opposed walls being slanted inwardly to form a hopper portion, a plurality of openings formed in each of said opposed walls immediately above its slanted portion, at least two gasifiers extending adjacent said opposed wall portions, respectively, and surrounding the respective slanted wall portions and openings, so that the respective interiors of said gasifiers communicate with said openings, means for introducing fuel to each gasifier, means in each gasifier for supporting a bed of adsorbent material for the sulfur generated as a result of the gasification of said fuel, and means for passing air through said bed of adsorbent material to fluidize said material so that, upon gasification of said fuel, a substantially sulfur-free product gas is produced which passes from said gasifier, through said openings and into said furnace section, such that combustion of the gas and unreacted carbon occurs.

2. The system of claim 1 wherein each gasifier includes means for regenerating the adsorbent containing said sulfur to produce a sulfur gas.

3. The system of claim 1 wherein said fuel is oil which is injected into said fluidized bed.

4. The system of claim 1 wherein said fuel is coal which is introduced into said fluidized bed.

5. The system of claim 1 wherein each of said opposed walls form a common wall for said furnace section and for a respective gasifier.

6. The system of claim 1 further comprising a windbox surrounding said opposed walls and the portions of each gasifier surrounding said openings.

7. The system of claim 6 further comprising a plurality of nozzles extending from said windbox to said openings to introduce air to said openings where it mixes with said product gas as it enters said furnace section.

8. The system of claim 7 further comprising a single source of air, and duct means for passing said air to said bed of adsorbent material and to said windbox.

9. The system of claim 8 further comprising means for passing the combustion gases from said furnace section in a heat exchange relation to said air before said air is passed to said bed of adsorbent material and to said windbox.

10. The system of claim 6 wherein said upright walls of said furnace section are formed by a plurality of tubes for receiving water to convert said water to steam.

11. The system of claim 1 wherein said gasifiers are each integrally formed with a sorbent regenerator.

* * * * *